US006640930B1

(12) United States Patent
Peters et al.

(10) Patent No.: US 6,640,930 B1
(45) Date of Patent: Nov. 4, 2003

(54) LOCKING-COLLAPSIBLE SAW HORSE

(76) Inventors: Larry W. Peters, 7060 Mandarin Rd., Sarasota, FL (US) 34238; Larry W. Peters, Jr., 7060 Mandarin Rd., Sarasota, FL (US) 34238; James A. Peters, 7060 Mandarin Rd., Sarasota, FL (US) 34238

( * ) Notice: Subject to any disclaimer, the term of this patent is extended or adjusted under 35 U.S.C. 154(b) by 0 days.

(21) Appl. No.: 10/151,070

(22) Filed: May 21, 2002

(51) Int. Cl.[7] ..... E04G 1/34
(52) U.S. Cl. ..... 182/153; 182/151; 182/225
(58) Field of Search ..... 182/25, 153, 155, 182/182.3, 182.4, 186.3, 186.5, 225, 226, 151

(56) References Cited

U.S. PATENT DOCUMENTS

| | | | | | |
|---|---|---|---|---|---|
| 1,726,662 | A | * | 9/1929 | Goff | 182/153 |
| 2,427,679 | A | * | 9/1947 | Larson | 182/153 |
| 2,882,021 | A | * | 4/1959 | Dreher | 182/153 |
| 2,900,158 | A | * | 8/1959 | Ditter | 182/153 |
| 3,047,092 | A | * | 7/1962 | Janda | 182/153 |
| 3,148,746 | A | * | 9/1964 | Juculano | 182/153 |
| 3,785,455 | A | * | 1/1974 | Waldron | 182/22 |
| 4,057,215 | A | * | 11/1977 | Stettler | 248/460 |
| 4,658,337 | A | * | 4/1987 | Burke | 362/225 |
| 4,771,863 | A | * | 9/1988 | Stansberry | 182/155 |
| 5,467,842 | A | * | 11/1995 | Meloy | 182/153 |
| 6,142,256 | A | * | 11/2000 | Dirk, II | 182/153 |
| 2002/0011381 | A1 | * | 1/2002 | Wilkerson | 182/153 |
| 2002/0038741 | A1 | * | 4/2002 | Krajec | 182/153 |
| 2002/0166725 | A1 | * | 11/2002 | Gulledge | 182/153 |
| 2002/0195531 | A1 | * | 12/2002 | Walker | 248/228.4 |

FOREIGN PATENT DOCUMENTS

| | | | | |
|---|---|---|---|---|
| FR | 2574333 | * | 6/1986 | 182/153 X |
| GB | 2330612 | * | 4/1999 | 182/153 |

* cited by examiner

*Primary Examiner*—Bruce A. Lev
(74) *Attorney, Agent, or Firm*—Frank A. Lukasik

(57) ABSTRACT

A lockable, tubular steel saw horse scaffold support consisting of four legs, each pair of legs being joined together with a crossbar and rotatably connected to a top bar. A chain attached across the crossbars for holding the legs in an open position and an arm having a looped end moveably connected to a link on a first crossbar and a hooked end having a kinked protrusion for selectively locking the arm to a first link on the second crossbar or for locking the arm in a storage position to a second link on the first crossbar.

1 Claim, 8 Drawing Sheets

LOCKING-COLLAPSIBLE SAW HORSE

BACKGROUND OF THE INVENTION

The present invention relates to saw horses to support walking planks for use in the construction/DIY industries and more particularly to a collapsible metal horse which can be locked in the open position to provide a safe and stable platform support.

The building and construction industries have used traditionally, all manner of scaffolding and framing to support workers and give them access to awkward or dangerous locations on buildings etc. Generally such supports provide an elevated walking surface over which workers can move safely and which can support not only the worker but tools, materials and equipment being used on the site. In the process of building, painting, plastering etc, as sections of the project are completed, the scaffold walkways often are moved to give access to a new section of the site. Traditional metal scaffolding requires assembly and careful placement which is a costly process that is not cost effective in many construction jobs such as home building. Home builders rely generally upon easel support frames to hold their walking planks because easels are simple to deploy and can be set up to give access to an entire wall of a house in just a few minutes. Such devices are however, inherently unstable, because they are prone to collapse if they are suddenly loaded or moved in a direction perpendicular to their angle of placement. These easels form an "A" shape and have a chain connecting the cross braces of each leg. Chains are secure only when they are loaded under tension such as when the legs of the "A" are apart. It is while these legs are apart that the walking plank is positioned atop the cross braces of each leg and across to another easel spaced within reach of the walking plank. It is not uncommon in the rush to deploy these easels and planks, for workers to slide the planks in position only to tip the easel and cause it to collapse.

This is inconvenient and unsafe.

The present invention provides a simple, effective and inexpensive solution to these and other such problems inherent in prior art easels. The present invention not only solves the problem of collapsing easels, but provides a range of sizes/heights which are simply and safely deployable from the lowest easel to the highest.

SUMMARY OF THE INVENTION.

It is a primary object of the invention to provide an easel which can be locked in the open position.

It is a further object of the invention to provide a stabilizing arm positioned between the cross braces of each leg of the easel and fixed by female links welded to each cross brace It is a further object of the invention to make the stabilizing arm securable in both the deployed and undeployed position using the female links.

It is a further object of the invention to shape the arm with a hooked and kinked end to act as a friction lock against the edges of the female link.

It is a further object of the invention to provide a chain attached by female links to each cross brace.

It is a further object of the invention to provide easels of various heights each with a stabilizing arm and chain.

It is a further object of the invention to provide easels which rapidly and safely can be deployed.

It is a further object of the invention to provide an easel which is rust-proof and galvanized.

It is a further object of the invention to provide non-skid rubber feet to protect flooring.

DETAILED DESCRIPTION OF A PREFERRED EMBODIMENT

Figure 1:
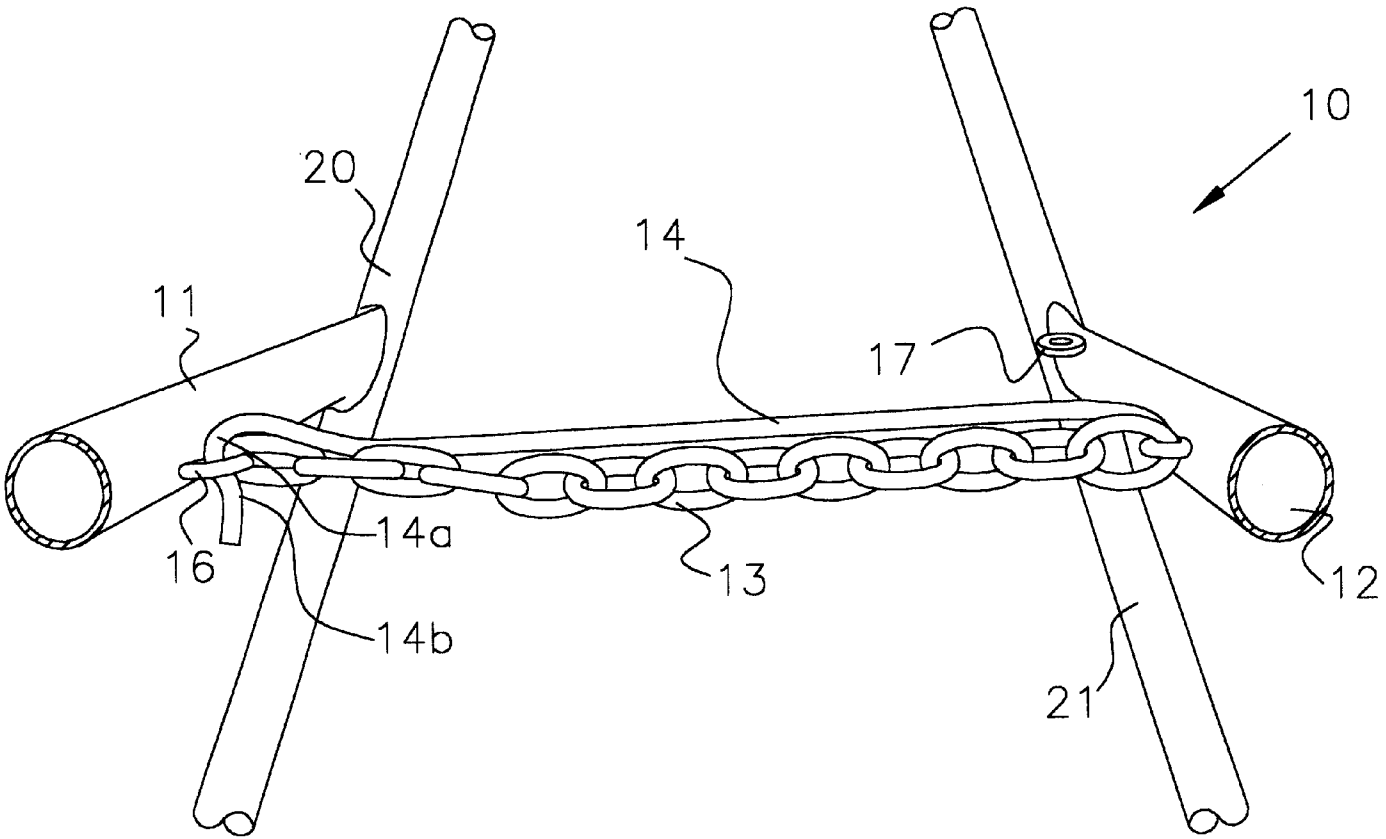
FIG. 1 is a cross sectional elevational view of the invention in it' locked position.

Referring now to the drawings in which like numerals designate like and corresponding parts throughout the several views, in FIG. 1 the invention easel is designated overall by the numeral 10. Chain 13 connects cross bars 11 and 12 together. Locking arm 14 also connects the cross bars 11 and 12. Arm 14 shares locking link 16 with chain 13. Hook 14*a* attaches arm 14 to link 16 and kink 14*b* prevents arm 14 from accidentally releasing from link 16.

Legs 20 and 21 support cross bars 11 and 12. Link 17 is welded to cross bar 12 and becomes a storage means for arm 14 (FIG. 3.)

Figure 2:
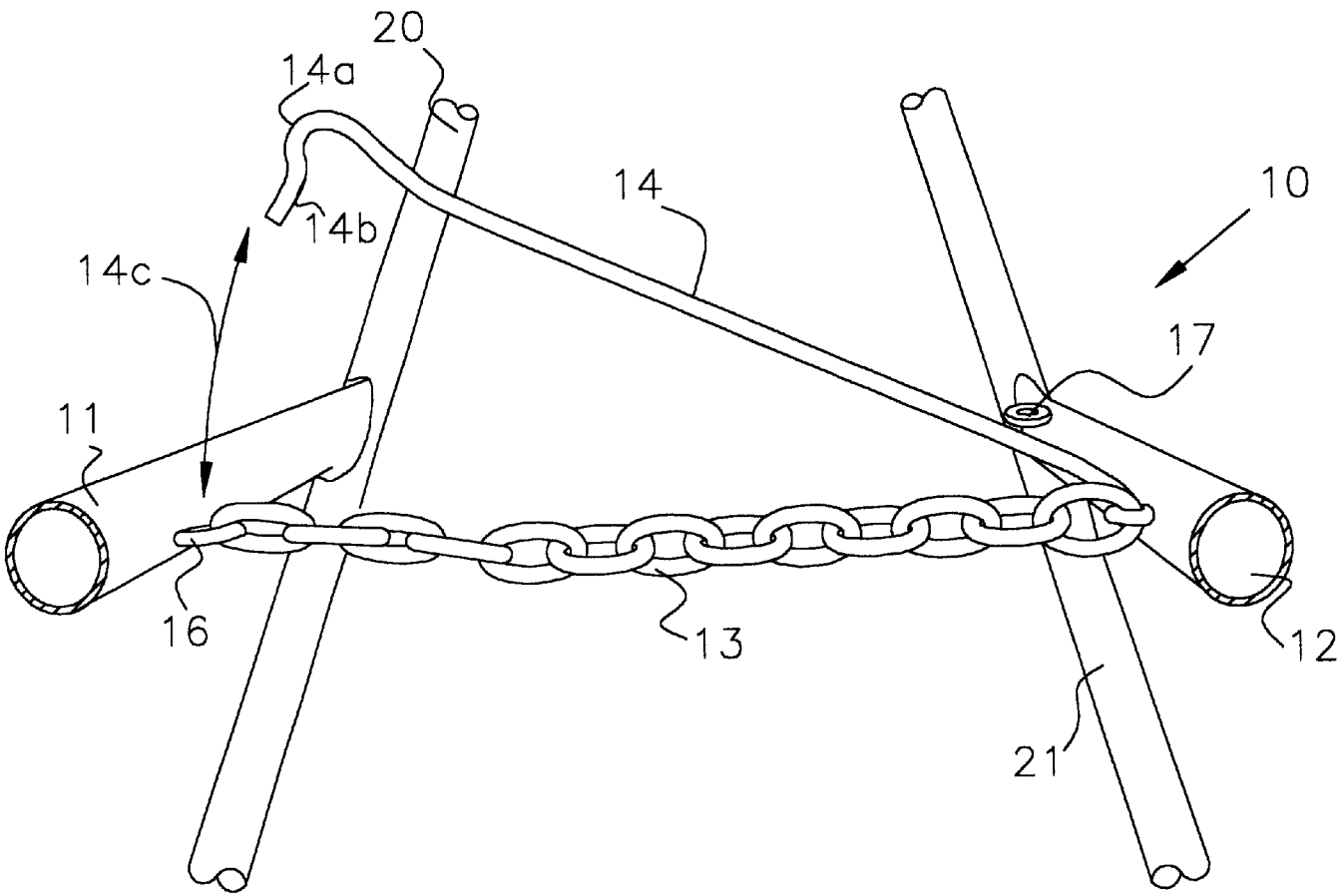
FIG. 2 is a cross sectional elevational view of the invention in its unlocked position.

Referring now to FIG. 2, in which arm 14 is raised in the direction of arrow 14*c*. Arm 14, kink 14*b* and hook 14*a* are radially aligned between cross bars 11 and 12.

Figure 3:
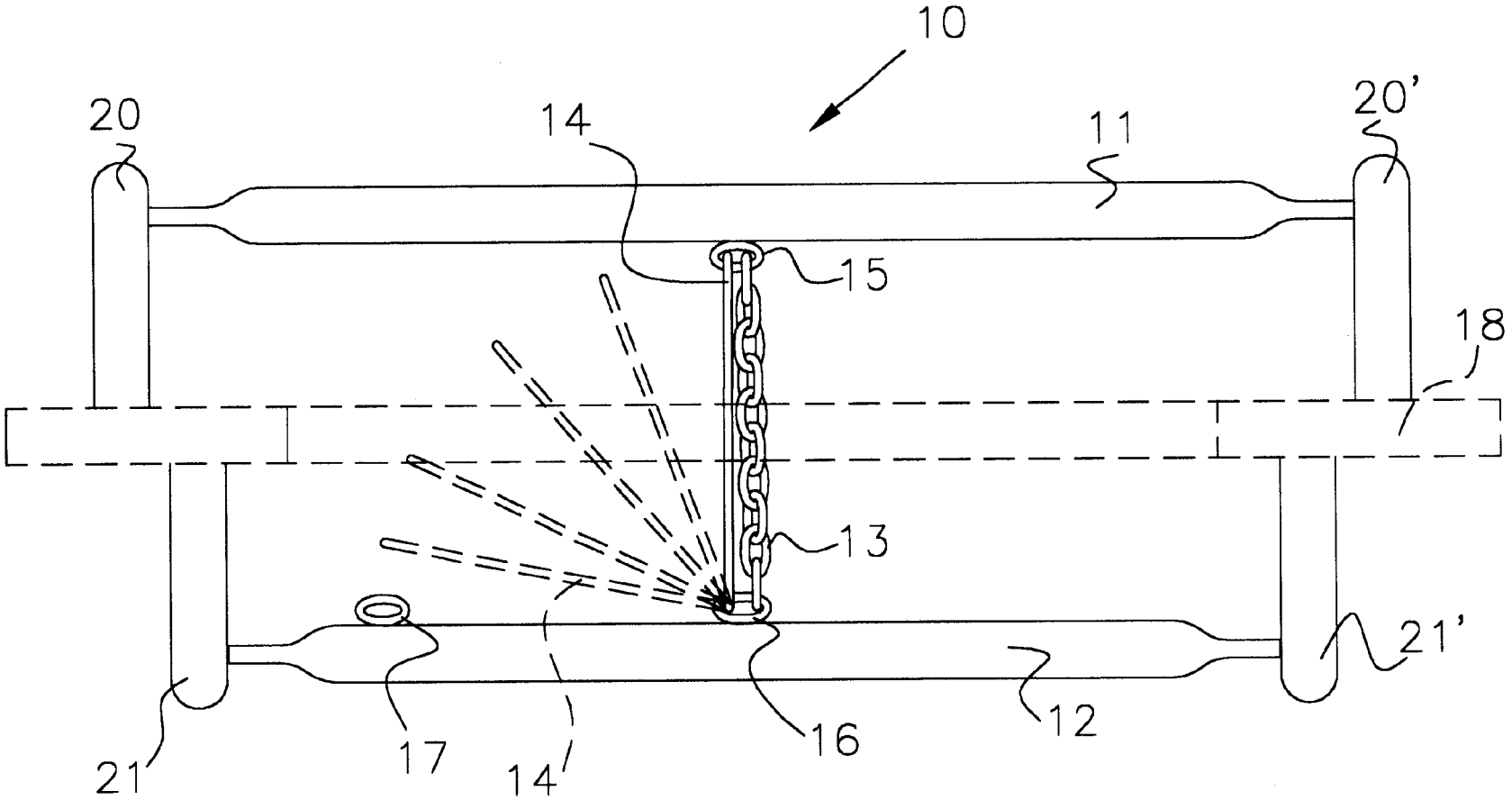
FIG. 3 is a plan view of the invention showing the deployment of the locking bar.

Referring now to FIG. 3, top bar 18 connects to legs 20, 20', 21, and 21'. Cross bars 11 and 12 connect legs 20 and 20' and legs 21 and 21' respectively. Cross bars 11 and 12 are releasably connected together by chain 13 and arm 14. Arm 14 moves radially between welded links 15 and 16 and can be reposed within welded link 17.

Figure 4:
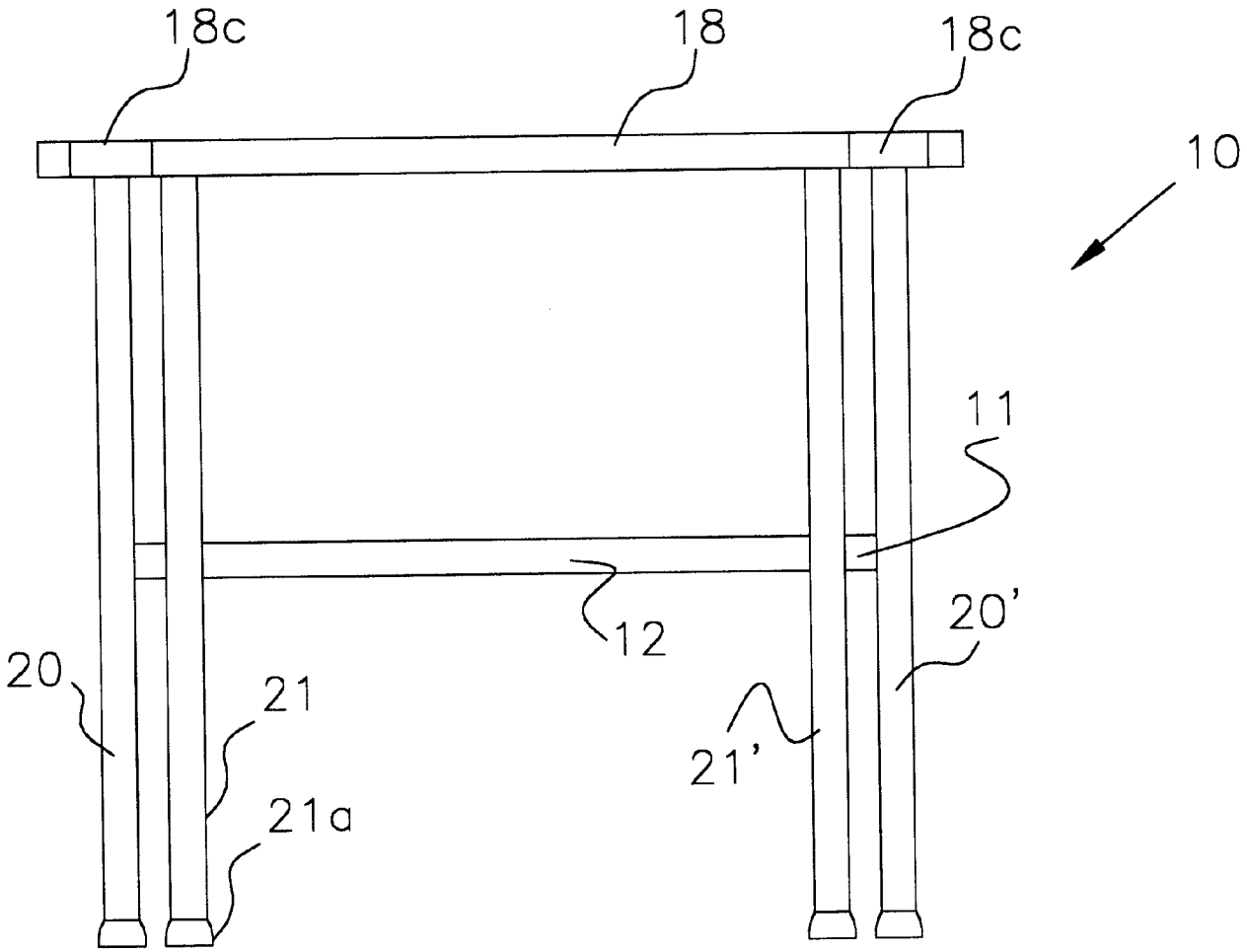
FIGS. 4–8 are elevational views of the invention in its different sized configurations.
Figure 5:
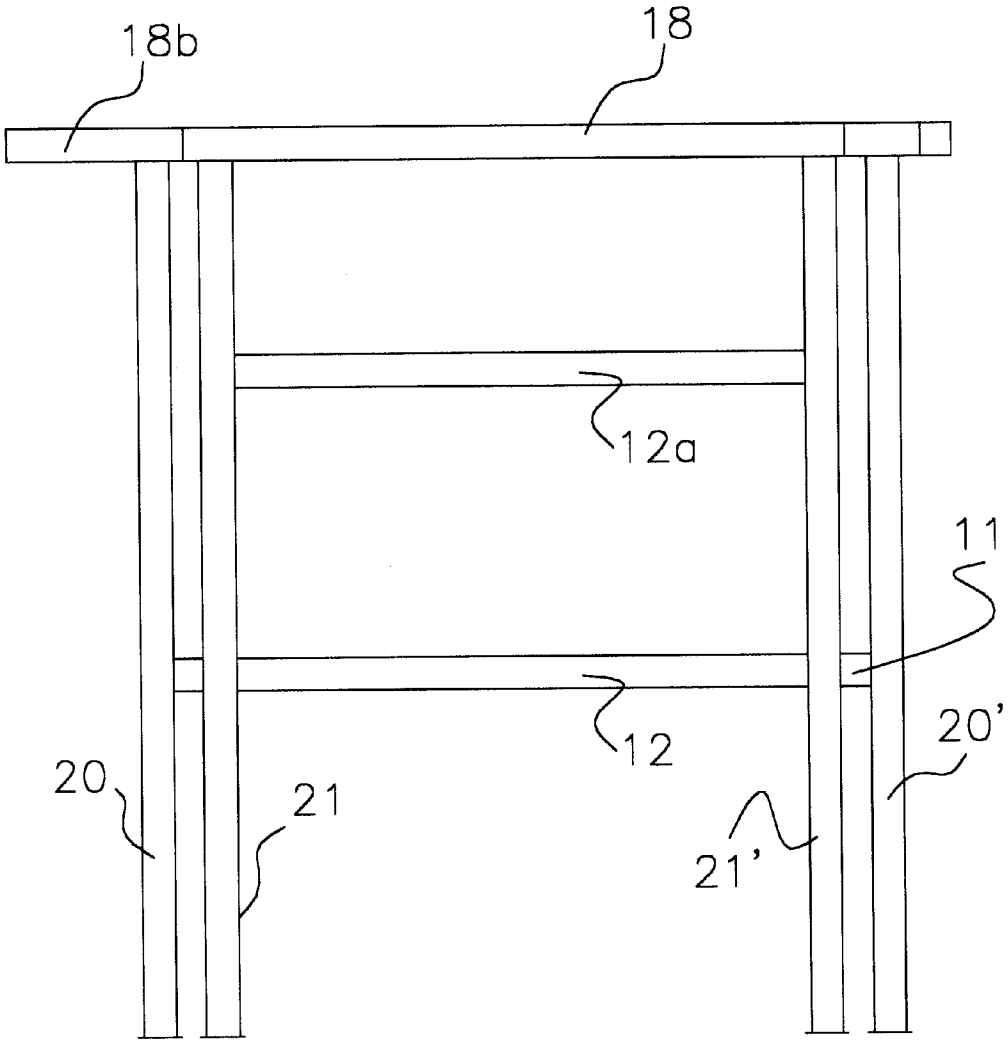
Figure 6:
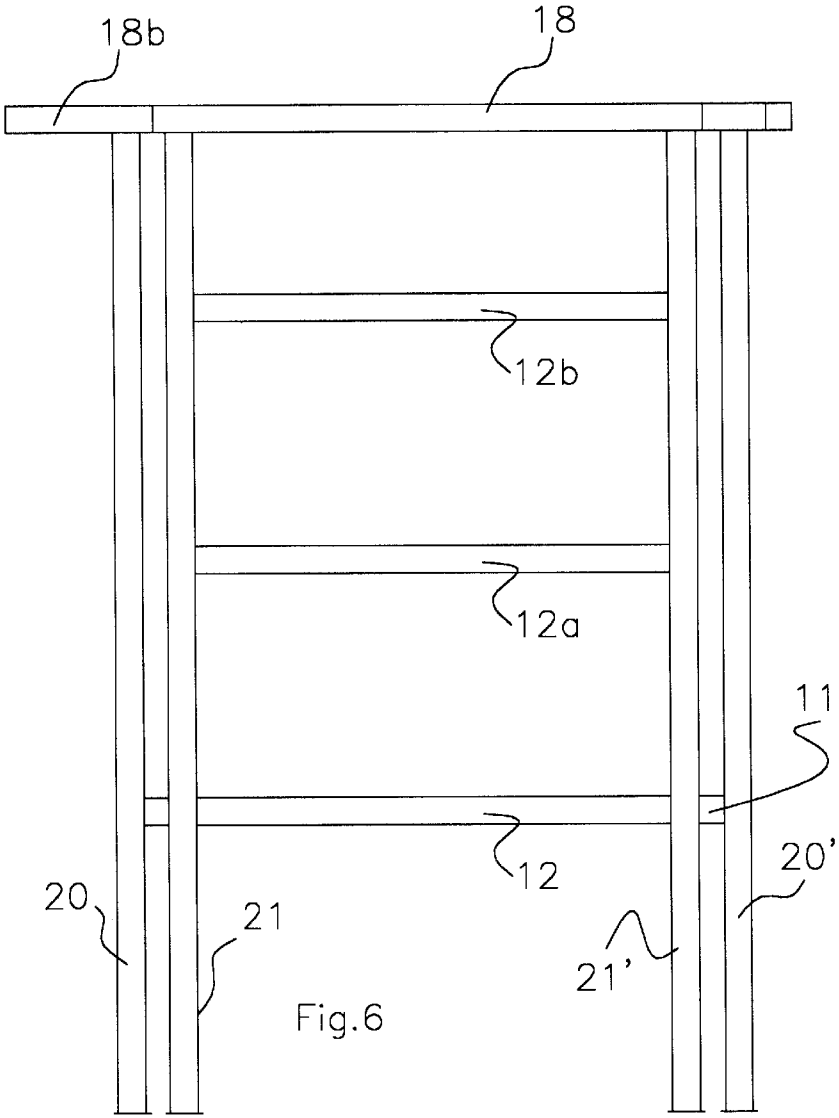
Figure 7:
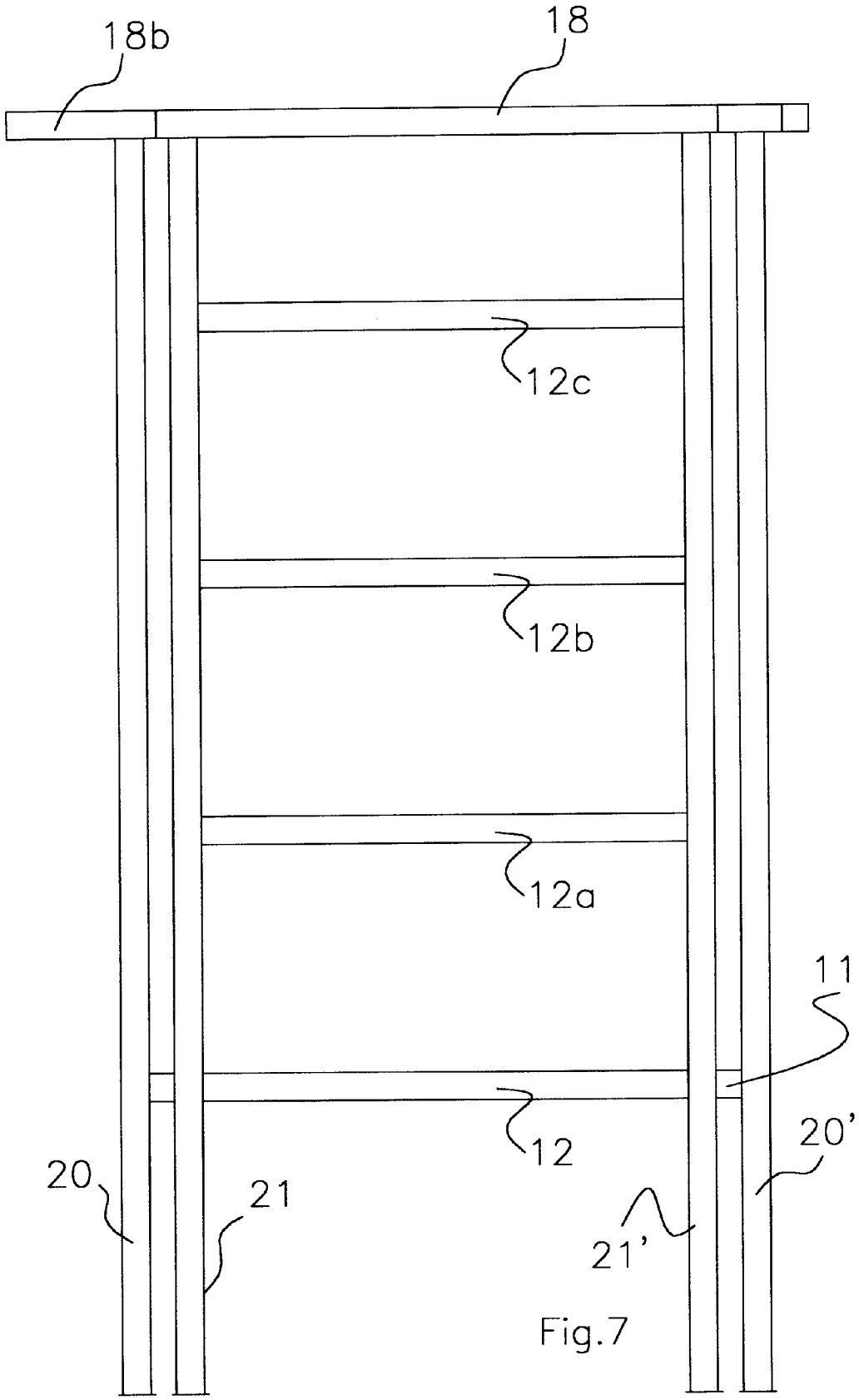
Figure 8:
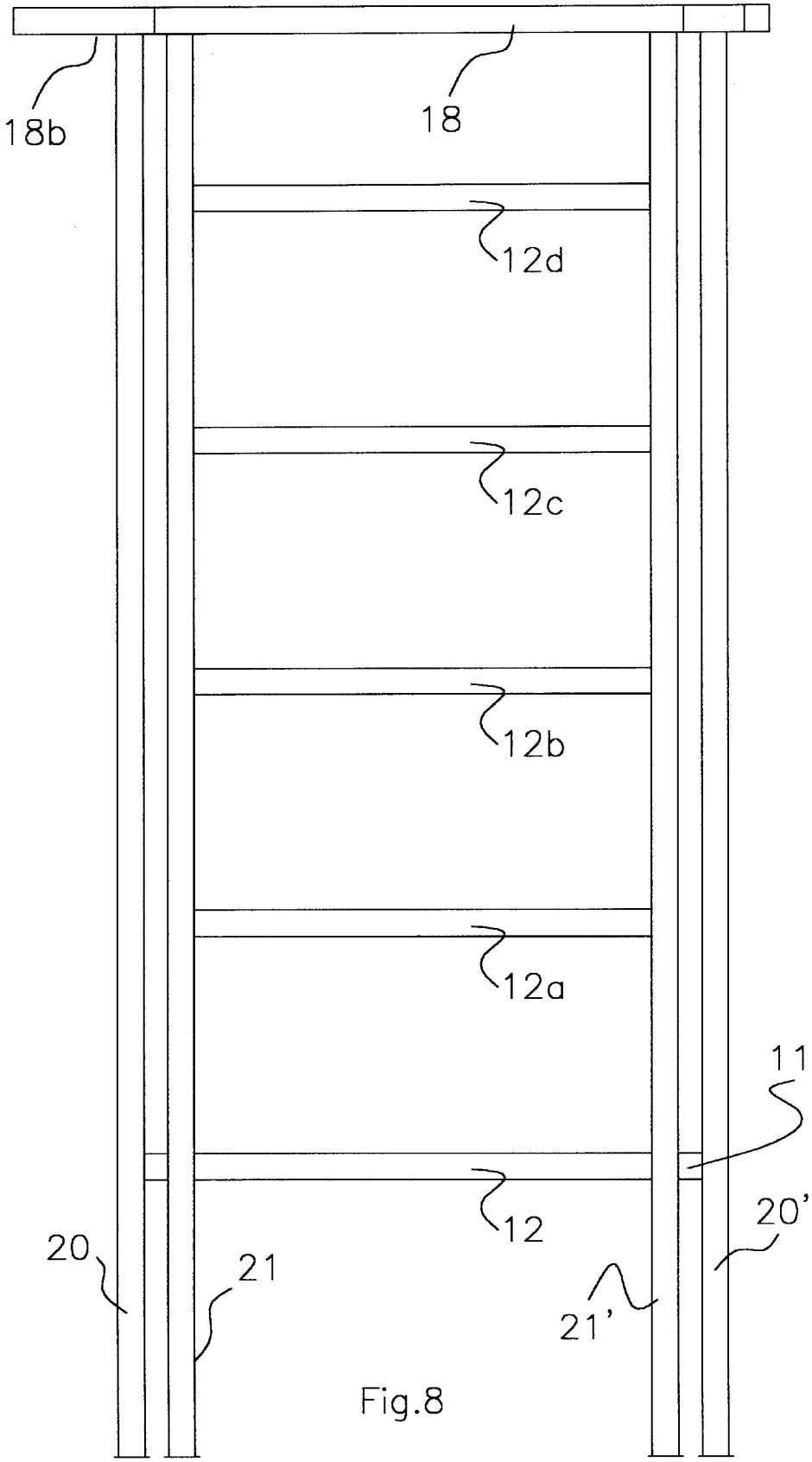

In FIG. 4, easel 10 has non-marring feet 21*a* attached to each leg. Cross bars 11 and 12 connect legs 20 and 20' and 21 and 21' respectively. Swivel point 18*c* permits the easel 10 to swing open and closed by moving legs 20 and 20' independently of top bar 18.

Referring now to FIGS. 5–8 in which additional cross bars 12*a*–12*d* are added to each sized easel. Beginning with FIG. 5, cross bar 12*a* is added and legs 20, 20', 21 and 21' are extended to make the easel taller. This incremental size increase is repeated through FIG. 8 which is the tallest version of the easel having reached a height of 72". Sizes for each version are as follows; FIG. 4, 32", FIG. 5 36", FIG. 6 48" FIG. 7 60" and then FIG. 8 at 72". These easels have in common top extension 18*b*, these extensions adding horizontal stability by being rested against a wall or other solid surface.

What is claimed is:

1. A lockable tubular steel saw horse scaffold support comprising:

a plurality of legs, each of said legs having a top portion and a bottom portion a first crossbar connecting a first pair of said legs and a second crossbar connecting a second pair of said legs to form bipedal units, a top bar having an extension fastened at each end and a swivel point fastened at opposite ends, each of said top bar swivel points being moveably connected to each of said top portions of said pairs of legs forming an A-frame unit, a first link fastened at a midpoint of said first crossbar and a second link fastened at a midpoint of said second crossbar, a third link fastened to said first crossbar at a point located a measured distance from said first link, a chain having a first end fastened to said first link of said first crossbar, and a second end fastened to said second link of said second crossbar, and an arm, said arm having a first looped end and a second hooked end, said hooked end having a kinked protrusion, said arm being permanently and moveably fastened to said first link by said looped end and said hooked end being selectively removably attached to said second link for locking said crossbars in an extended position and removably attached to said third link in a closed position.

* * * * *